US005735303A

United States Patent [19]

Cole

[11] Patent Number: 5,735,303

[45] Date of Patent: Apr. 7, 1998

[54] CRUTCH AND LEG SUPPORTING APPARATUS

[76] Inventor: Joe C. Cole, 10902 Lockgate, Houston, Tex. 77048

[21] Appl. No.: 844,650

[22] Filed: Apr. 21, 1997

[51] Int. Cl.[6] ..... A45B 3/00

[52] U.S. Cl. ..... 135/66; 135/68

[58] Field of Search ..... 135/66, 68, 67, 135/74, 75, 65, 911, 77, 69

[56] References Cited

U.S. PATENT DOCUMENTS

| | | | |
|---|---|---|---|
| 1,006,791 | 10/1911 | Remick | 135/68 |
| 1,138,417 | 5/1915 | Rottenburg | 135/66 X |
| 2,127,976 | 8/1938 | Howat | 135/66 |
| 2,208,195 | 7/1940 | Paul | 135/68 |
| 4,062,372 | 12/1977 | Slusher | 135/66 |
| 4,910,927 | 3/1990 | Beatty | 135/68 X |
| 5,313,971 | 5/1994 | Upshaw | 135/68 |
| 5,318,068 | 6/1994 | Haugen | 135/66 |
| 5,575,299 | 11/1996 | Bieri | 135/68 X |

FOREIGN PATENT DOCUMENTS

| | | | |
|---|---|---|---|
| 2255881 | 7/1975 | France | 135/66 |

*Primary Examiner*—Lanna Mai
*Attorney, Agent, or Firm*—Kenneth D. Baugh

[57] ABSTRACT

A crutch and leg supporting apparatus 10 is provided. The apparatus 10 includes a crutch 12 and a leg assembly 60, coupled to the crutch which allows the crutch to be supported in a horizontal position. The leg assembly is provided with a pair of legs 62 which are pivotably mounted to the crutch 12 by a support member 74. The support member 74 allows legs 62 to be pivoted to a closed position to extend to a position parallel to the crutch when the crutch is used in an upright position and allows the legs to be pivoted in an open position to extend to a position diagonally outwardly from the crutch so that the crutch can be supported in a horizontal position to support a leg of a user.

9 Claims, 4 Drawing Sheets

CRUTCH AND LEG SUPPORTING APPARATUS

TECHNICAL FIELD

This invention relates to a crutch and more particularly to a crutch and leg supporting apparatus which is used to support a person having an injured leg or foot while walking and standing, and also allows the person to elevate the injured leg or foot while sitting. It goes without saying that the crutch has become a common therapeutic tool that is used by almost everyone in our society at one time or another because of injuries to the leg and/or foot. Because of the nature of leg and foot injuries, the crutch is very valuable as a therapeutic tool in facilitating healing because it allows the user to minimize pressure on the injured limb while the person is standing and/or walking. With these kind of injuries healing is also facilitated by elevation of the injured limb after walking and/or standing. A stand of some sort is typically used to satisfy this need. The need for the crutch as well as the stand is apparent. However a more desirable arrangement would be a single apparatus which supports the person while standing and/or walking and also allows a person to support the limb an elevated position when the person is sitting.

BACKGROUND ART

There are a number of different types of devices which provide support for individuals who experience injuries to their legs or feet. One such apparatus is disclosed in U.S. Pat. No. 5,313,971. This apparatus utilizes a pair of conventional crutches and an adjustable crutch sling assembly. The sling assembly includes a top cover to which a leg sling is attached by flexible straps. The cover is intended to fit over the shoulder rests of the pair of crutches and is shaped in such a way to allow creation of an A frame structure from which the sling is supported by connecting straps. The connecting straps are preferably adjustable to allow positioning the leg sling at a desired height for supporting the user's leg while the user is sitting.

Another such device is disclosed in U.S. Pat. No. 5,318,608. This device includes a crutch and an assembly which is attached to the crutch and is shiftable between collapsed and erect positions. When the device is in the erect position the cast of the user is in a sitting position. When the device is in the collapsed position it is supported vertically in an out of the way position from the crutch of the user.

Both these devices while serving the purposes for which they were designed are some what complicated structurally, and do not allow the crutch itself to act as a support member for elevating the injured limb. An apparatus is desired which actually permits the crutch itself to support the injured limb of the person in the elevated position.

DISCLOSURE OF THE INVENTION

A crutch and leg supporting apparatus is provided. The crutch and leg supporting apparatus of this invention includes a first pair of spaced elongated support members having spaced aligned apertures formed therein. An upper horizontally extending support member is coupled to uppermost portions of the first pair of elongated support members. The crutch and leg supporting apparatus also includes an intermediate horizontally extending support member which is coupled between intermediate portions of the first pair of elongated support members. Additionally, a lower support member is provided having elongated portions thereof which are slidably couplable between lower most portions of the first pair of elongated support members. A second pair of elongated support members is provided. Still further the apparatus is provided with a means for pivotably coupling the second pair of elongated support members to lowermost portions of the first pair of elongated support members. As a result when the first pair of elongated support members are used in a substantially vertical position the second pair of elongated support members can be pivoted to a closed position to extend downwardly to a position substantially parallel to the first pair of elongated support members. Additionally, when the first pair of elongated support members are used in a substantially horizontal position the second pair of elongated support members can be pivoted to an open position to extend outwardly to a position substantially diagonally from the first pair of elongated support members.

BEST MODE FOR CARRYING OUT THE INVENTION

Figure 1:
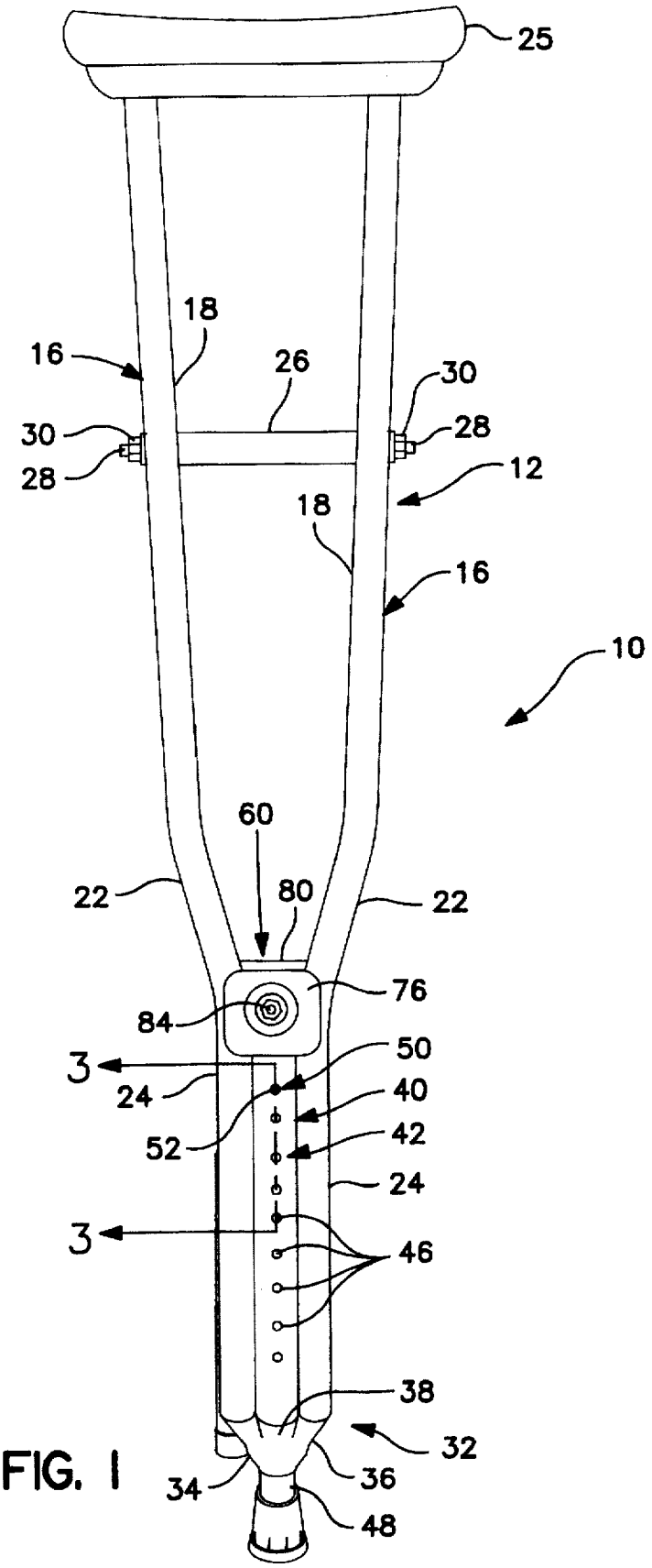
FIG. 1 is a perspective view of a crutch and leg supporting apparatus in accordance with the principles of the invention.
Figure 2:
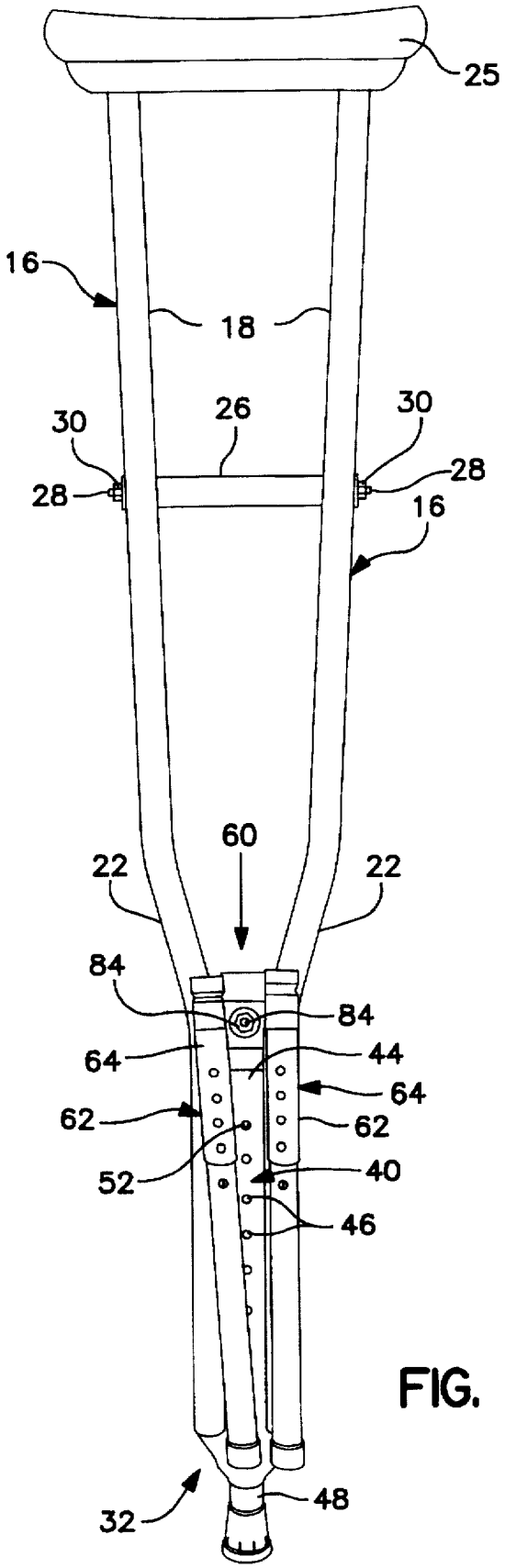
FIG. 2 is another perspective view of a crutch and leg supporting apparatus in accordance with the principles of the invention.

Referring to FIGS. 1 and 2 a crutch and leg supporting apparatus, generally designated, by the numeral 10 is provided. The crutch and leg supporting apparatus 10 is provided with a crutch, generally designated, by the numeral, 12. The crutch 12 includes a pair of legs generally designated, by the numerals, 16. The legs 16 are formed with an upper vertically extending member 18 having apertures 20 (FIG. 5) formed therein. Each leg 16 also includes a diagonally descending member 22 which is coupled to the upper vertically extending member 18. A lower vertically extending member 24 is coupled to each of the diagonally descending members 22. The crutch 12 is also provided with an upper horizontally extending support member 25 coupled to upper portions of the legs 16. The support member 25 of the crutch 12 acts as a shoulder rest for supporting the user of the crutch.

The crutch 12 also includes an intermediate horizontally extending support member 26. The support member 26 serves as a hand grip for the user of the crutch. The hand grip 26 is movably mounted between the legs 16 on a shaft 28 supported in predetermined apertures 18 in the legs. The hand grip is held in place between the legs 16 by coupling members or bolts 30 coupled to the ends of the shaft 28.

A lower V-shaped support member, generally designated, by the numeral 32, is provided. The support member 32 includes outermost leg supporting members 34 and 36 and an intermediate leg supporting member 38 formed between the outermost members. The intermediate leg supporting member 38 is formed with an interior hollow portion (not shown) which extends through the member. The leg supporting members 34 and 36 are each coupled to one of the legs 16 at lowermost portions of the legs.

A leg assembly, generally designated, by the numeral 40 is formed between the lower vertically extending members 24 of the legs 16. The leg assembly 40 includes planar shaped vertically extending front and back support members 42 and 44 respectively. The front and back support members 42 and 44 each include a plurality of spaced apertures 46 formed therein. The apertures 46 are spaced so that each one of the apertures in the support member 42 is directly aligned with one of apertures in the support member 44.

Figure 3:
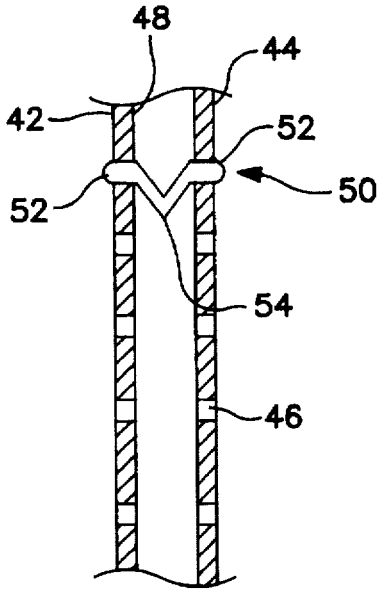
FIG. 3 is a sectional view along lines 3—3 in FIG. 1 of a crutch and leg supporting apparatus in accordance with the principles of this invention.

The leg assembly 40 is also provided with a leg 48 which is slidably mounted between the support members 42 and 44 of the leg assembly to extend through the hollow portion of the intermediate leg supporting member 38. The leg 48 includes a spring loaded abutting member, generally designated, by the numeral, 50 (FIG. 3). The member 50 is provided with a pair of aperture engaging members 52 and a V-shaped spring member 54 coupled between the engaging members. The aperture engaging members 52 are provided for lockingly engaging the apertures 46 in the support members 42 and 44. The spring loaded abutting member 50 is structured so that aperture engaging members 52 are normally spring biased in an outward direction by the spring 54. This allows the engaging members 52 to be normally engage adjacently aligned apertures 46. Accordingly when the engaging members 52 are pressed inwardly they disengage from the adjacently aligned apertures 46. When the engaging members are disengaged from the apertures 46 the leg 48 can slide between the support members 42 and 44 until the engaging members are again aligned with apertures 46 in the support members. This of course permits the engaging members 52 to again lockingly engage the adjacently aligned apertures 46 to lock the leg 48 in that position. This arrangement permits the leg 48 to be adjusted upwardly and downwardly to increase or decrease the length of the crutch 12 and thereby accommodate the particular height of the user of the crutch 12.

Figure 4:
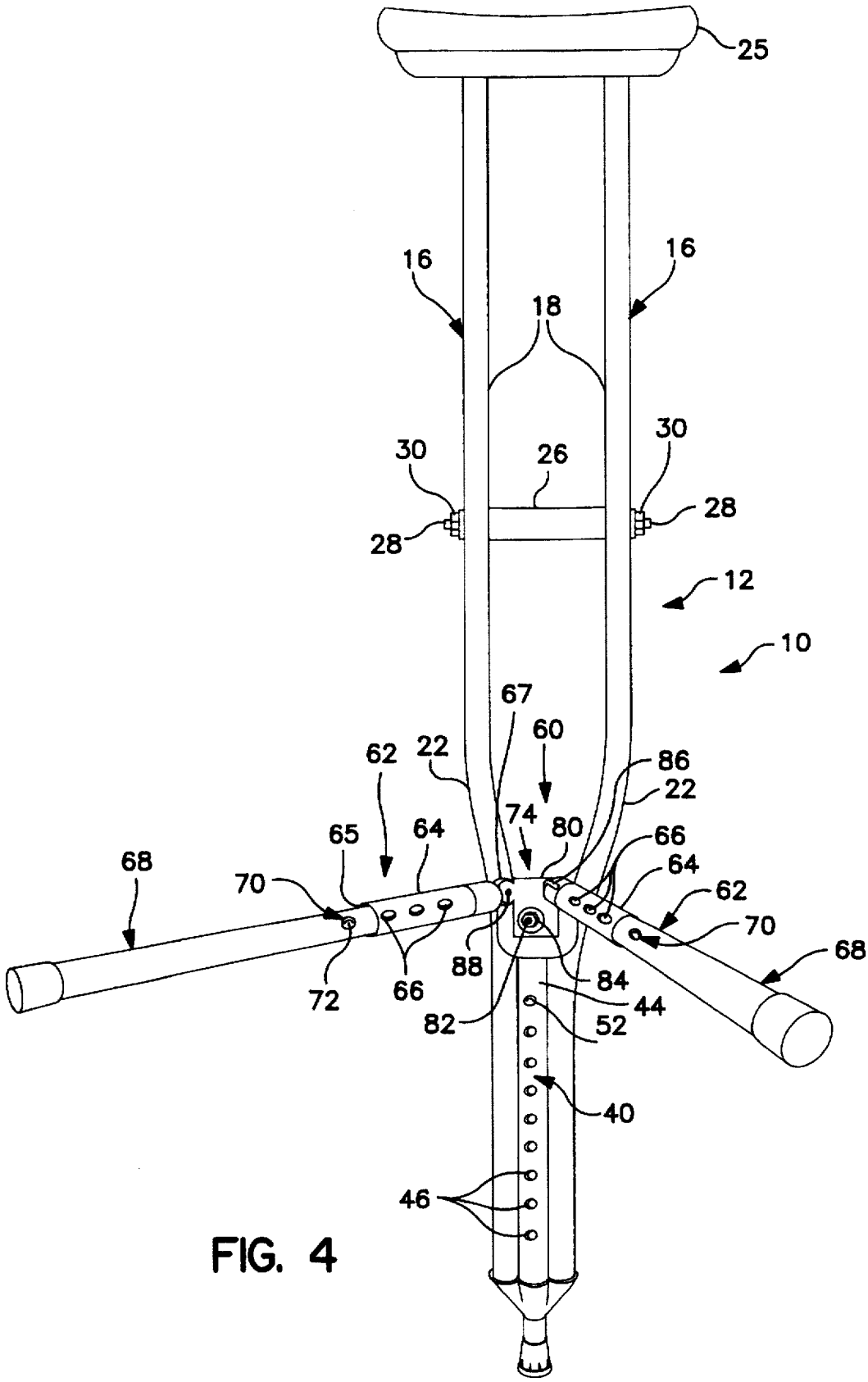
FIG. 4 is a perspective view of the bottom portions of a crutch and leg supporting apparatus in accordance with the principles of the invention.
Figure 5:
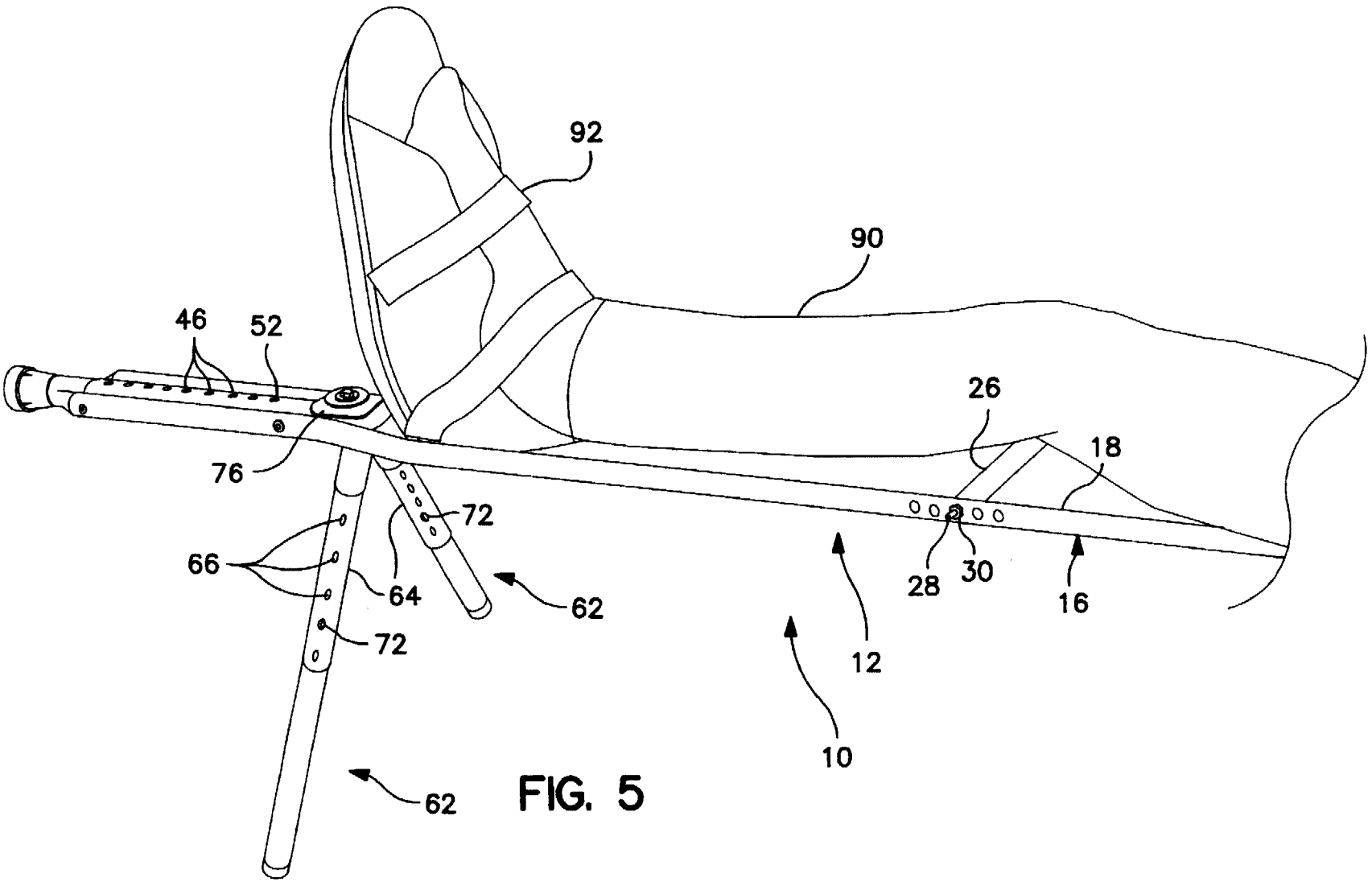
FIG. 5 is a side elevational view of the crutch and leg supporting apparatus in accordance with the principles of the invention.

Referring to FIGS. 4 and 5 the crutch and leg supporting apparatus 10 also includes a second leg assembly, generally designated, by the numeral, 60. The leg assembly 60 allows the crutch 12 to be supported in a horizontal position. (FIG. 5) The leg assembly 60 is provided with a pair of legs, generally designated, by the numerals, 62. The legs 62 are provided with an upper leg member 64 having an elongated hollow portion 65 formed therein and having spaced aligned apertures 66 formed on the front and back portions thereof. The apertures 66 are spaced so that each one of the apertures on the front of the upper leg member 64 is directly aligned with one of the apertures on the back of the upper leg member (only front portion shown). The upper leg member 64 is also provided with a coupling portion having spaced flange members 67 having spaced aligned apertures (not shown) formed therein.

Each leg 62 is also provided with a lower leg member 68 which is mounted for slidable movement in the hollow portion 65 of the upper leg member 64. The lower leg member 68 is provided with a spring loaded abutting member, generally designated, by the numeral, 70 which is identical to the spring loaded abutting member 50, illustrated in FIG. 3. The member 70 is provided with aperture engaging members 72 (only one shown) and a V-shaped spring member such as spring member 54 (FIG. 3) coupled between the engaging members. The aperture engaging members 72 are provided to lockingly engage the apertures 66 in the upper leg member 64. The abutting member 70 is structured so that aperture engaging members 72 are normally spring biased in an outward direction by the spring 54. As a result when the engaging members 72 are pressed inwardly they are disengaged from the adjacently aligned apertures 66. When the engaging members 72 are disengaged from the apertures 66 in the upper leg member 64 the leg member can slide in the hollow portion 65 of the upper leg member 64 until the engaging members are again aligned with apertures 66. This permits the engaging members 72 to again lockingly engage the adjacently aligned apertures 66 to lock the leg member 68 in that position. This arrangement permits the lower leg member 68 to be adjusted upwardly and downwardly to vary the length of the legs 62.

The leg assembly 60 is also provided with a support member, generally designated, by the numeral, 74 for pivotably coupling the legs 62 to crutch 12. The support member 74 is provided with one planar support member 76 (FIG. 1) which is aligned adjacent to one side of the crutch 12 and another planar support member 80 (FIG. 4) which is aligned adjacent to another side of the crutch. The planar support members 76 and 80 are each provided with an adjacently aligned aperture formed therein (not shown) which receives a coupling member, such as, for example a threaded bolt 82. A nut 84 is provided to be threadadely coupled to the bolt 82 so that the planar support members 76 and 80 are coupled to the crutch 12 in a well known manner.

The planar support member 80 also includes a leg coupling member 86 coupled to each side thereof(only one shown) for pivotably coupling the upper leg member 64 to the support member. The coupling member 86 is provided with an aperture (not shown) formed therein. The coupling member 86 is aligned between the flange members 67 in the upper leg member 64 and pivotably coupled thereto by a pivot pin 88 which extends through the apertures in the flange and the aperture in coupling member. This permits the legs 62 to be moved to an open position as illustrated in FIGS. 4 and 5 or closed position as illustrated in FIGS. 1 and 2.

The crutch and leg supporting apparatus 10 is provided to support a person in an upright position and to allow the leg or foot of the person to be elevated when the person is sitting. When it is desired to use the crutch and leg supporting apparatus 10 as a crutch, that is, when a person needs support for walking and/or standing the leg assembly 60 is folded to the closed position as illustrated in FIGS. 1 and 2. The leg 48 may be adjusted upwardly or downwardly, as described herein to accommodate the height of the person. Similarly, the hand grip 26 may be adjusted to accommodate the preference of the person. The shoulder rest 25 of the crutch 12 is then placed under the arm of the person to provide the support needed by the person. The crutch 12 can then be used in a well known manner to assist the person when standing and walking.

When the person desires to sit and elevate the leg or foot, the leg assembly 60 is unfolded and moved to an open position as illustrated in FIGS. 4 and 5. The shoulder rest 25 of the crutch can then be supported on a structure such as, for example a chair (not shown) on which the person is sitting so that the legs 68 of the leg assembly 60 are resting on the floor or other such supporting structure and so that the crutch 12 extends outwardly in a horizontal position. The leg 90 and foot 92 of the person can then be placed on the crutch 12 as illustrated in FIG. 5 so that it is maintained in the elevated position.

It should be understood that various changes and modifications can be made without departing from the spirit of the invention as defined in the claim.

What is claimed:

1. A crutch and leg supporting apparatus including:

a first pair of spaced elongated support members having spaced aligned apertures formed therein;

an upper horizontally extending support member coupled to uppermost portions of the first pair of elongated support members;

an intermediate horizontally extending support member coupled between intermediate portions of the first pair of elongated support members;

a lower support member having elongated portions thereof slidably couplable between lower most portions of the first pair of elongated support members;

a second pair of elongated support members, each one of the second pair having an upper end portion; and means for pivotably coupling the second pair the upper end portions of of elongated support members to lowermost portions of the first pair of elongated support members so that when the first pair of elongated support members are used in a substantially vertical position the second pair of elongated support members can be pivoted to a closed position to extend downwardly to a position substantially parallel to the first pair of elongated support members and so that when the first pair of elongated support members are used in a substantially horizontal position the second pair of elongated support members can be pivoted to an open position to extend outwardly to a position substantially diagonally to the first pair of elongated support members said first pair of elongated support members would be raised above the grounds.

2. A crutch and leg supporting apparatus as defined in claim 1 wherein each one of the first pair of elongated support members includes:

an upper vertically extending member having apertures formed therein;

a diagonally descending member coupled to the upper vertically extending member; and a lower vertically extending member coupled to the diagonally descending member.

3. A crutch and leg supporting apparatus as defined in claim 2 wherein the uppermost horizontally extending support member is coupled to uppermost portions of the vertically extending members to provide a shoulder rest for supporting a user of the crutch.

4. A crutch and leg supporting apparatus as defined in claim 3 wherein the intermediate horizontally extending support member includes:

a shaft; and a horizontally extending hand grip member mounted on the shaft, the shaft being movably mounted in the apertures in the upper vertically extending members to allow the horizontally extending grip member to be selectively adjusted between the upper vertically extending members.

5. A crutch and leg supporting apparatus as defined in claim 4 wherein the lower elongated support member includes:

a first support member, having spaced aligned apertures formed therein, coupled to one side of the lower vertically extending members of the first pair of elongated support members;

a second support member aligned with and spaced from the first support member, having spaced aligned apertures formed therein, coupled to another side of the lower vertically extending members of the first pair of elongated support members; and an elongated member slidably mounted between the first and second support members.

6. A crutch and leg supporting apparatus as defined in claim 5 wherein the elongated member of the lower support member includes:

a first aperture engaging member coupled in one side of the elongated member;

a second aperture engaging member coupled in another side of the elongated member; and a spring member coupled between the first and second aperture engaging members inside the elongated member so that when the engaging members are aligned with apertures in the first and second support members the spring member causes the engaging members to lockingly engage the apertures to hold the elongated member in a predetermined position.

7. A crutch and leg supporting apparatus as defined in claim 6 wherein each one of the second pair of elongated members include:

an upper elongated member having an elongated hollow portion formed therethrough and a plurality of spaced aligned apertures formed thereon; and a lower elongated member slidably mounted in the hollow portion of the upper elongated member.

8. A crutch and leg supporting apparatus as defined in claim 7 wherein the lower elongated member includes:

a third aperture engaging member coupled in one side of the lower elongated member;

a fourth aperture engaging member coupled to another side of the elongated member; and a spring member coupled between the third and fourth aperture engaging members inside the lower elongated member so that when the engaging members are aligned with apertures in the upper elongated member the spring member causes the engaging members to lockingly engage the apertures to hold the lower elongated member in a predetermined position in the upper elongated member.

9. A crutch and leg supporting apparatus as defined in claim 8 wherein the coupling means includes:

a planar support member coupled adjacent to one side of the lower vertically extending members of the first pair of elongated support members;

a first coupling member coupled to an upper portion of the planar support member on one side thereof;

a second coupling member coupled to an upper portion of the planar support member spaced from and aligned with the first coupling member;

first pivot members for pivotably coupling one of the upper elongated members to the first coupling member so that one of the second pair of elongated members can be selectively pivoted to the open and closed position; and a second pivot member for pivotably coupling the other one of the upper elongated members to the second coupling member so that the other one of the second pair of elongated members can be selectively pivoted to the open and closed positions.

* * * * *